US008635847B2

(12) United States Patent
Knudsen

(10) Patent No.: US 8,635,847 B2
(45) Date of Patent: Jan. 28, 2014

(54) APPARATUS AND A SYSTEM FOR TWISTING A STRING OF WRAPPED AND SPUN TOBACCO LEAVES

(75) Inventor: Jorgen Purup Knudsen, Skive (DK)

(73) Assignee: House of Oliver Twist A/S, Odense (DK)

( * ) Notice: Subject to any disclaimer, the term of this patent is extended or adjusted under 35 U.S.C. 154(b) by 805 days.

(21) Appl. No.: 12/600,244

(22) PCT Filed: May 16, 2008

(86) PCT No.: PCT/DK2008/000183

§ 371 (c)(1),
(2), (4) Date: Sep. 15, 2010

(87) PCT Pub. No.: WO2008/138344

PCT Pub. Date: Nov. 20, 2008

(65) Prior Publication Data

US 2011/0011050 A1 Jan. 20, 2011

(30) Foreign Application Priority Data

May 16, 2007 (EP) ..... 07388034

(51) Int. Cl.
*D02G 3/06* (2006.01)

(52) U.S. Cl.
USPC ..... 57/31; 57/260

(58) Field of Classification Search
USPC ..... 57/31, 260; 19/266, 267; 131/111, 112, 131/117, 118; 414/26
See application file for complete search history.

(56) References Cited

U.S. PATENT DOCUMENTS

| | | | | | |
|---|---|---|---|---|---|
| 209,808 | A | * | 11/1878 | Holley | 131/117 |
| 1,062,796 | A | * | 5/1913 | Rabe | 57/31 |
| 1,762,918 | A | * | 6/1930 | Dodge | 40/316 |
| 1,943,381 | A | * | 1/1934 | Gammeter | 57/31 |
| 2,176,019 | A | * | 10/1939 | Cohoe | 264/282 |
| 3,444,683 | A | * | 5/1969 | Hessenbruch | 57/31 |

(Continued)

FOREIGN PATENT DOCUMENTS

| | | |
|---|---|---|
| DE | 106211 | 11/1899 |
| DE | 173122 | 11/1906 |

(Continued)

OTHER PUBLICATIONS

International Search Report on related PCT application (PCT/DK2008/000183); International Searching Authority (EPO) dated Sep. 1, 2008.

*Primary Examiner* — Shaun R Hurley
(74) *Attorney, Agent, or Firm* — Klein, O'Neill & Singh, LLP

(57) ABSTRACT

An apparatus (5) for twisting a first string (10) of wrapped and spun tobacco leaves into a second string (20) of twisted tobacco leaves defines a first axis (30) extending substantially in the direction of the first string. The apparatus (5) includes a set of rollers (40, 50, 60) each defining a respective circumferential twisting surface (41, 51, 61) for contacting the first string, the circumferential twisting surfaces (41, 51, 61) being arranged so as to substantially confine the first string (10) therebetween so as to rotate the first string (10) and to cause the first string (10) to rotate and be twisted by means of the twisting surfaces (41, 51, 61), and simultaneously to cause the second string (20) to be conveyed along the first axis (30) and out of the apparatus (5).

15 Claims, 6 Drawing Sheets

(56) References Cited

U.S. PATENT DOCUMENTS

| | | | | | |
|---|---|---|---|---|---|
| 3,678,674 | A | * | 7/1972 | De Voe | 57/335 |
| 3,695,990 | A | * | 10/1972 | Chopra | 428/369 |
| 4,519,195 | A | * | 5/1985 | Belin et al. | 242/447.3 |
| 4,631,911 | A | * | 12/1986 | Young et al. | 57/1 UN |
| 4,766,719 | A | * | 8/1988 | Young, Jr. | 57/1 UN |
| 4,768,262 | A | * | 9/1988 | Gunter | 19/258 |
| 4,874,000 | A | * | 10/1989 | Tamol et al. | 131/375 |
| 4,989,620 | A | * | 2/1991 | Keritsis et al. | 131/371 |
| 5,799,374 | A | * | 9/1998 | Strobel et al. | 19/274 |
| 5,953,793 | A | * | 9/1999 | Roder | 19/266 |
| 2010/0059069 | A1 | * | 3/2010 | Boldrini | 131/112 |
| 2010/0071711 | A1 | * | 3/2010 | Boldrini | 131/112 |

FOREIGN PATENT DOCUMENTS

| | | |
|---|---|---|
| GB | 21083 | 9/1914 |
| GB | 216051 | 5/1924 |
| GB | 226026 | 12/1924 |
| GB | 451140 | 7/1936 |

* cited by examiner

APPARATUS AND A SYSTEM FOR TWISTING A STRING OF WRAPPED AND SPUN TOBACCO LEAVES

CROSS-REFERENCE TO RELATED APPLICATION

This application is a national phase filing, under 35 U.S.C. §371(c), of International Application No. PCT/DK2008/000183, filed May 16, 2008, the disclosure of which is incorporated herein by reference in its entirety.

FEDERALLY SPONSORED RESEARCH OR DEVELOPMENT

Not Applicable

BACKGROUND

The present invention relates to an apparatus for twisting a string of wrapped and spun tobacco leaves, such as whole tobacco leaves, half tobacco leaves or parts of tobacco leaves and tobacco products such as homogenised tobacco products or alternative products originating from tobacco leaves or parts thereof, provided to the apparatus into a string of twisted tobacco leaves. Additionally, the invention relates to two variants of a device for wrapping a string of overlaid tobacco leaves into a string of wrapped and spun tobacco leaves. Moreover, the invention relates to a system. Further, the present invention relates to a method of producing a string of twisted tobacco leaves.

The production of spun twisted tobacco leaves in the form of spun twisted tobacco leaves is fundamentally based on old craftsmanship traditions, and the small pieces of tobacco are still in some places twisted by hand as they were back in 1805. The end products e.g. are small, discreet mini-rolls of tobacco or tobacco pellets with a natural nicotine content that soothes the urge to smoke. The mini-rolls may be delivered in a box typically vacuum packed to ensure a shelf life of one year.

Twisted tobacco as smokeless tobacco has a positive environmental effect, due to the fact that it often replaces traditionally smoked tobacco. For twisted tobacco the taste and the release of nicotine lasts for at least one hour, thus far fewer pellets will be used in a day as compared to smoking cigarettes.

Internationally, the term "smokeless tobacco" applies to a wide range of products whose common feature is that they do not have to be consumed as opposed to other smoke tobacco products, and logically no smoke is the result making the smokeless tobacco environmental friendly and usable in areas, where smoking in the normal sense is prohibited by regulations enforced by the public authorities.

One of the most common forms of smokeless tobacco originating from Europe is spun twisted chewing tobacco made of whole or half tobacco leaves that are twisted into a strand and cut into small pieces. Other forms are snuff, which is dried, pulverised tobacco snuffed into the nose. Moist snuff is granulated tobacco mixed with water and is also used in the mouth. Alternatively portion-packed snuff is used, which is similar to moist snuff but is packed in small, porous bags—like tea bags—and is used in the mouth. The mentioned small, discreet mini-rolls are e.g. about 1×0.5 cm and have a natural nicotine content that quells the urge to smoke. The mini-roll is to be inserted between the cheek and the jaw. The tobacco mini-roll will give off taste and nicotine for at least one hour. The tobacco mini-roll is not be swallowed after use, but is discarded as a chewing gum.

The German Patentschrift 173122, dating back to 1905, discloses a process where the tobacco leaves are laid on a table and manually fed between rubber rollers. The result of the process is a loose, inhomogeneous twisted string of tobacco, which is unsuitable for further processing, e.g. for cutting or slicing into e.g. tobacco mini-rolls.

From GB 226,026, accepted for grant back in 1924, a method of manufacturing tobacco in twist or roll form is known. The machine utilises a complicated set up of mechanical parts such as feeding rolls, cams, gear wheels, etc and is manually operated.

U.S. Pat. No. 5,632,287 discloses a method of making a smoking article where a sheet of reconstituted tobacco is manually or machine folded into a substantially flat strip of tobacco, thus no string of twisted tobacco leaves is provided.

However, the technique of manufacturing twisted tobacco prior to separating e.g. slicing or cutting the twisted tobacco, typically from a string, into e.g. a mini-roll is as discussed primarily based on old, manually based craftsmanship traditions. This is also reflected in GB 226,026 and the German Patentschrift 173122. Thus, an automated, quick, efficient, adjustable and reliable apparatus, system and method for providing the string of twisted tobacco are needed by the smoke-less industry.

SUMMARY OF THE DISCLOSURE

It is an object of the invention to provide an automated way of providing a string of twisted tobacco leaves. Further, it is an object to provide equipment and a system which supports and automates the process of providing a string of twisted tobacco leaves.

Moreover, it is an object of the invention to provide an equipment and a system, which are adjustable and can be adapted to the tobacco leaves.

Additionally, it is an object of the invention to provide a process of providing a string of twisted tobacco leaves.

The above objects, the above advantage and the above feature together with numerous other objects, advantages, and features, which will be evident from the below detailed description of the present invention, are, in accordance with a first aspect of the present invention, obtained by an apparatus for twisting a first string of wrapped and spun tobacco leaves, such as whole tobacco leaves, half tobacco leaves or parts of tobacco leaves, provided to the apparatus into a second string of twisted tobacco leaves, the apparatus defining a first axis extending substantially in the direction of the first string, the apparatus comprising a set of rollers each defining a respective circumferential twisting surface for contacting the first string and each defining a respective rotational axis, the rotational axes of the set of rollers being arranged skewly relative to one another and relative to the first axis, the circumferential twisting surfaces being arranged so as to substantially confine the first string therebetween and for rotating the first string around the first axis, and a motor for rotating the set of rollers and causing the first string to rotate and be twisted by means of the twisting surfaces and simultaneously causing the second string to be conveyed along the first axis and out of the apparatus. In an embodiment of the invention according to the first aspect of the invention, the set of rollers constitutes two rollers. In another embodiment of the invention according to the first aspect of the invention, the set of rollers constitutes three rollers.

In an embodiment of the invention according to the first aspect of the invention the axes of the three rollers are arranged skewly with respect to one another, typically with a pitch angle in the interval from 30 to 60 degrees relative to the first axis. Typically, the rollers are rotating at a speed of 100-10,000 rpm, such as 200-1000 rpm, preferably 300-500 rpm such as approximately 400-450 rpm, providing a speed of transport of the string of 1.5 m/min-1500 m/min such as 3 m/min-15 m/min such as 5-8 m/min.

In an embodiment of the invention, the angle is in the interval from 35 to 45 degrees, 37 to 42 degrees, 45 to 60 degrees, 47 to 58 degrees or 50 to 54 degrees. In an embodiment of the invention, the angle is 30, 32, 34, 36, 38, 40, 42, 44, 46, 48, 50, 52, 54, 56, 58 or 60 degrees. In an embodiment of the invention, the angle is 31, 33, 35, 37, 39, 41, 43, 45, 47, 49, 51, 53, 55, 57 or 59 degrees.

In an embodiment of the invention according to the first aspect of the invention, the three positions of the axes of the three rollers are adjustable skewly in relation to one another relative to the first axis to any of the above mentioned distinct angle values so as to allow the above mentioned angle to be adjusted.

In an embodiment of the invention according to the first aspect of the invention, the three rollers being arranged in a first plane perpendicular to the first axis and on a periphery of a circle in the first plane, the circle having its centre on the first axis such that a projection of the three rollers on a second plane perpendicular to the first axis forms a substantially equilateral triangle. In other embodiments of the invention according to the first aspect of the invention, the set of rollers comprises four or more rollers. In an embodiment of the invention according to the first aspect of the invention, the four rollers being arranged in a third plane perpendicular to the first axis and on a respective side of a rectangle in the third plane such that a projection of the four rollers on a fourth plane perpendicular to the first axis forms a substantially perfect square. In an embodiment of the invention according to the first aspect of the invention, the circumferential twisting surface is formed in an hourglass shape and the circumferential twisting surface partly extending on the surface of the respective roller. In an embodiment of the invention according to the first aspect of the invention, the set of rollers is driveable with the same speed and rotational direction.

The above objects, the above advantage and the above feature together with numerous other objects, advantages and features, which will be evident from the below detailed description of the present invention, in accordance with a first variant of a second aspect of the present invention, are obtained by a device for wrapping overlaid tobacco leaves provided to the device into a first string of wrapped and spun tobacco leaves, the device comprising a roller for catching and wrapping the overlaid tobacco leaves, a cavity extending parallel with the roller for guiding the overlaid tobacco leaves during wrapping, the cavity forming an acute angle relative to the transporting direction of the overlaid tobacco leaves, and a motor for rotating the roller. The first variant of the second aspect of the present invention, i.e. the device for wrapping overlaid tobacco leaves further comprises a shaft extending parallel with the roller, the shaft allowing the device to be turned between an operational position and an opened, non-operational position, e.g. for inspection, maintenance and/or cleaning.

The above objects, the above advantage and the above feature together with numerous other objects, advantages and features, which will be evident from the below detailed description of the present invention are, in accordance with a second variant of the second aspect of the present invention, obtained by a device for wrapping overlaid tobacco leaves provided to the device into a first string of wrapped and spun tobacco leaves, the device comprising a cavity extending parallel with the device for guiding the overlaid tobacco leaves during wrapping, the cavity forming an acute angle relative to the transporting direction of the overlaid tobacco leaves. The second variant of the second aspect of the present invention, the device for wrapping overlaid tobacco leaves, further comprising a shaft extending parallel with the cavity, the shaft allowing the device being turned between an operational position and an opened, non-operational position, e.g. for inspection, maintenance and/or cleaning.

The above objects, the above advantage, and the above feature together with numerous other objects, advantages and features, which will be evident from the below detailed description of the present invention, in accordance with a third aspect of the present invention, are obtained by a system comprising the apparatus for twisting according to the first aspect, the device for wrapping overlaid tobacco according to the first or second variant of the second aspect, an infeed conveyor for providing overlaid tobacco leaves and having substantially parallel sides, where the device for wrapping overlaid tobacco in both variants are positioned such that the cavity of the device forms an acute angle relative to the parallel sides of the infeed conveyor so as to allow the device to capture the overlaid tobacco leaves from the infeed conveyor and to deliver the first string of wrapped and spun tobacco leaves to the apparatus for twisting according to the first aspect. In a preferred embodiment of the invention and realised by the applicant the acute angle is 48 degrees. In other embodiments of the invention, the acute angle is adjustable between 10-85 degrees, 15-82 degrees, 20-80 degrees, 25-75 degrees, 30-70 degrees, 35-65 degrees, 40-60 degrees, or 45-50 degrees. In further embodiments of the invention, the acute angle is adjustable between 10-50 degrees, 15-45 degrees, 20-40 degrees, 25-35 degrees, 50-90 degrees, 55-85 degrees, 60-80 degrees or 65-75 degrees.

The above objects, the above advantage and the above feature together with numerous other objects, advantages and features, which will be evident from the below detailed description of the present invention, are in accordance with a fourth aspect of the present invention obtained by a method of providing a string of twisted tobacco leaves, the method comprising the steps of (i) laying up two or more tobacco leaves in a partly overlapping relation, (ii) catching and wrapping the two or more tobacco leaves by means of a cavity and optionally by means of a roller into a first string of wrapped and spun tobacco leaves, and (iii) rolling and twisting the first string into a second string of twisted tobacco leaves, by means of a set of circumferential twisting surfaces of a respective set of skewly arranged rollers, between which surfaces the first string being confined, whilst simultaneously conveying the second string along its longitudinal axis. Further, the method comprises the step of winding the second string, e.g. around a bobbin.

BRIEF DESCRIPTION OF THE DRAWINGS

The four aspects of the invention will be explained in more detail below in connection with advantageous embodiments of the invention with reference to the drawings, in which.

DETAILED DESCRIPTION

Figure 1:
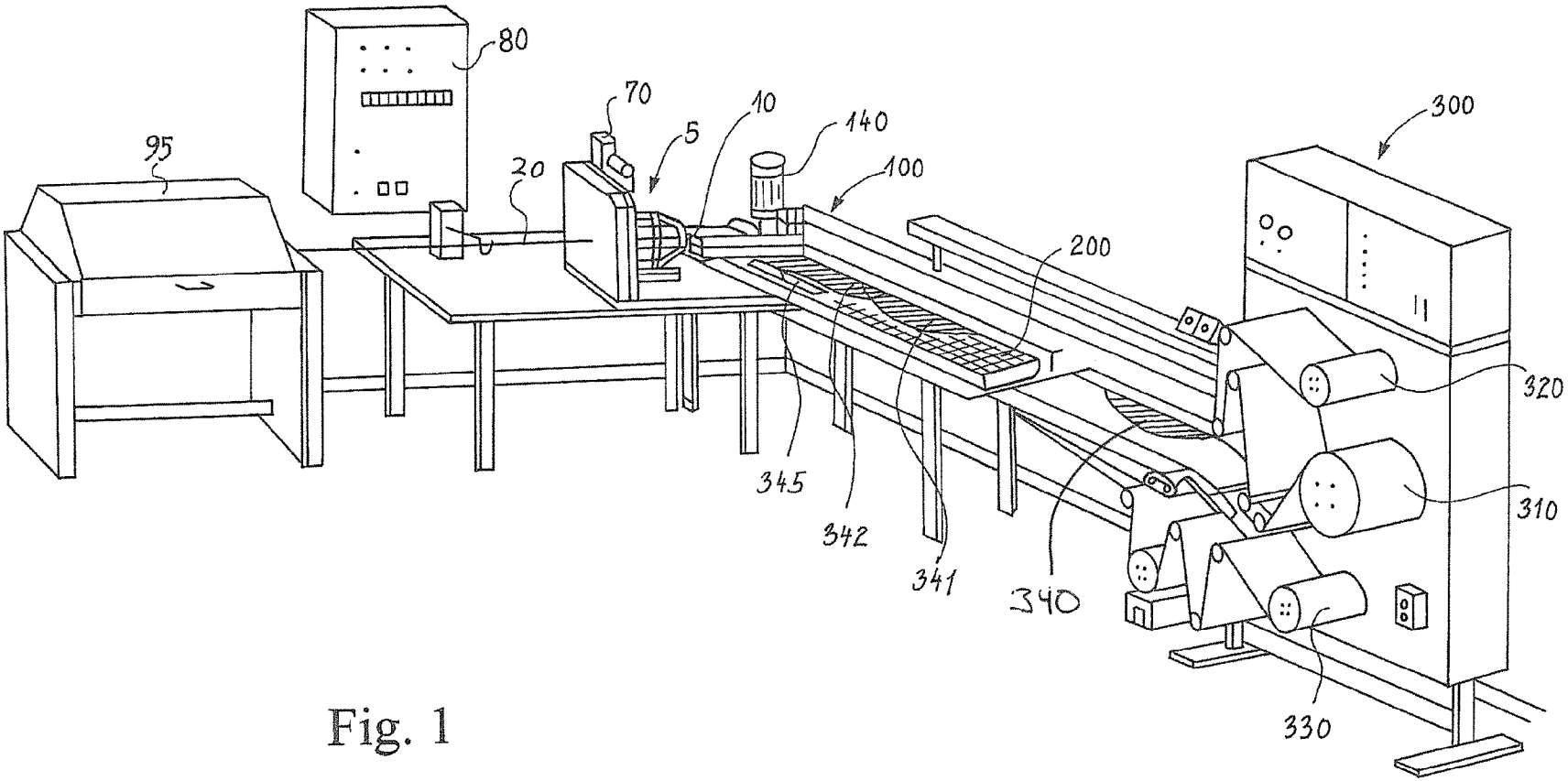
FIG. 1 shows an overview of a first and presently preferred embodiment of a system according to a third aspect of the invention.

Throughout the below description and in the drawings, identical components or elements present in different figures of the drawings are designated the same reference numerals and components or elements differing from a previously described component or element, respectively, however serving basically the same functional purpose as the previously described component or element, respectively, are designated the same reference numeral as the previously described component or element, respectively, however added a marking for indicating the geometrical difference from the previously described component or element, respectively.

FIG. 1 illustrates an overview of a system according to a third aspect of the invention. The process of providing twisted tobacco leaves from initially loose tobacco leaves is initiated at the right side of the figure from the un-spool apparatus 300. As a result of the spooling of the spools 310, 320 and 330, a loose tobacco leaf 340 is the result. A more detailed explanation of the apparatus 300 is given in connection with FIG. 6. The loose tobacco leaf 340 is manually laid up on the infeed conveyor 200 to the left-hand side of the apparatus 300, see also FIGS. 1, 2 and 3 for the conveyor 200. As illustrated in FIG. 1, two loose tobacco leaves 341 and 342 are laid upon one another in a partly overlapping relation on the conveyor 200; in a practical application, more than two tobacco leaves are applied; the tobacco leaves 341 and 342 illustrate the basic principle that more loose tobacco leaves are laid in a sequence in overlapping, typically partly, in relation with one another on the conveyor or belt 200. It requires experienced workers to handle and position the tobacco leaves 341 and 342 properly. However, it is possible to provide the leaves automatically. Sometimes, it is appropriate to fold parts of a tobacco leaf on itself. For this purpose, a guide plate 345 is provided on the conveyor 200. When the tobacco leaf 341 to be folded is close to the edge of the infeed conveyor 200, the tobacco leaf 341 is automatically folded onto itself by means of the guide plate 345 when the conveyor 200 moves.

Figure 2:
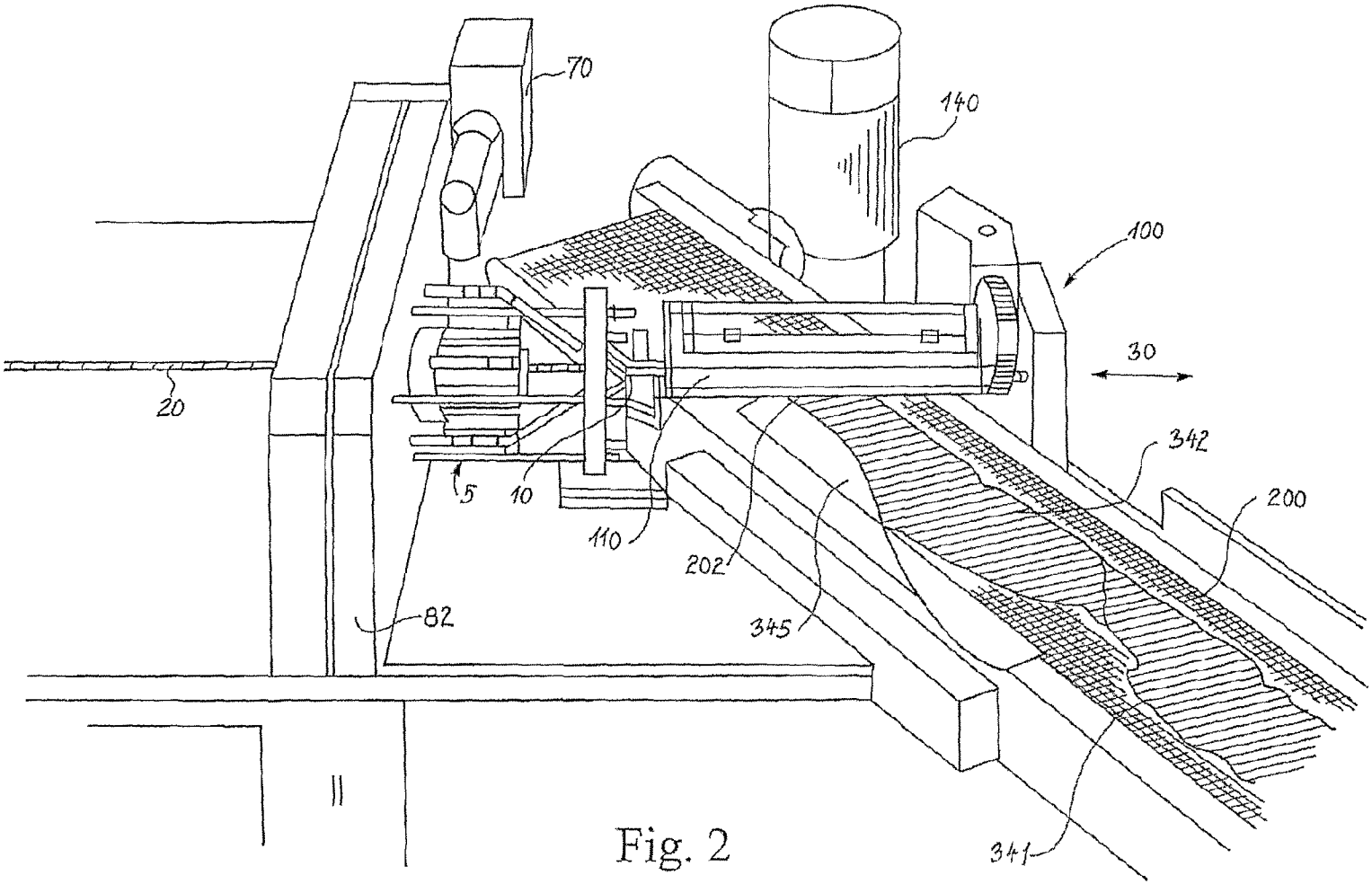
FIG. 2 shows a perspective drawing of an apparatus for twisting a string of wrapped and spun tobacco leaves into a string of twisted tobacco leaves according to a an embodiment of the invention in a first aspect of the invention, an infeed conveyor and a device for wrapping overlaid tobacco leaves according to an embodiment of the invention in a second aspect of the invention.
Figure 4:
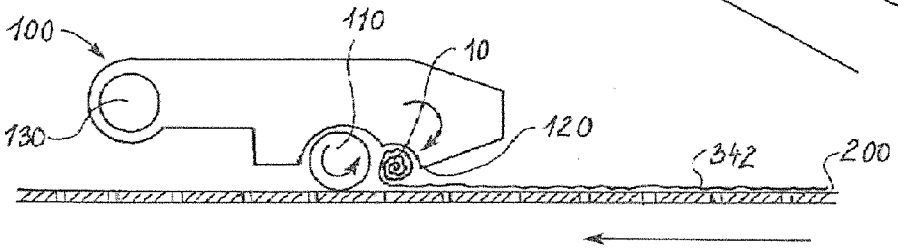
FIG. 4 shows a side view of the device for wrapping overlaid tobacco leaves according to an embodiment of the invention in the second aspect of the invention.
Figure 5:
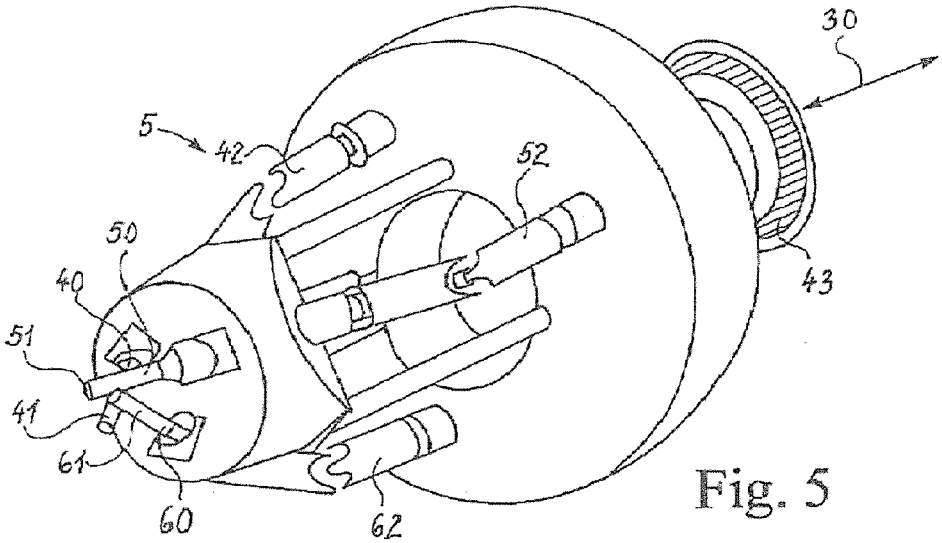
FIG. 5 shows a perspective drawing of a first prototype embodiment of an apparatus for twisting a string of wrapped and spun tobacco leaves into a string of twisted tobacco leaves according to the first embodiment of the invention in the first aspect of the invention.

The loose tobacco leaves, now in an overlaid configuration as overlaid tobacco leaves 341 and 342, proceed by means of the infeed conveyor or belt 200 to a device 100, see FIGS. 1, 2 and 5, which wraps the overlaid tobacco leaves. The device 100 for wrapping overlaid tobacco leaves produces a string 10 of wrapped and spun tobacco leaves. The string 10, see FIGS. 3 and 4, of wrapped and spun tobacco leaves is produced by means of a cavity 120 and possibly in conjunction with a roller 110 of the device 100, which is illustrated in detail in FIG. 4. The string 10 of wrapped and spun tobacco leaves is, when leaving the device 100 which wrapped the overlaid tobacco leaves, fed into a twisting apparatus 5.

The apparatus 5 serves the purpose of twisting the received string 10 of wrapped and spun tobacco leaves into another string 20 of twisted tobacco leaves. Further explanation of the apparatus 5 is given in connection with FIGS. 2 and 5.

The string 20 of twisted tobacco leaves is the result of the process, which takes place within the twisting apparatus 5. After leaving the twisting apparatus 5, the string 20 is fed to a spinning wheel 95 as illustrated in FIG. 1. The spinning wheel is provided with a bobbin (not shown) around which the string 20 of twisted tobacco leaves are wound. The apparatus for twisting 5, the spinning wheel 95 and the infeed conveyor 200 may be controlled by the same controller, e.g. a PLC, a microcomputer or a personal computer suitable for used in an industrial environment. The programmable controller is shown encased in the housing of 80. The controller may be supplemented by a vision system, which by means of a camera and a suitable processor can capture images of the overlaid tobacco leaves before entering the device. Hereby, the controller can react on e.g. measured variations in the amount of tobacco leaves entering the device and take corrective actions, e.g. change the pitch angle of the hourglass shaped twisting surfaces and the pitch angle of the device. The change of the angles may be performed by powering actuators connected to the rollers and by powering an actuator connected to the device 100 shown in FIGS. 1, 2 and 4.

FIG. 2 illustrates a perspective drawing of an apparatus for twisting a string of wrapped and spun tobacco leaves into a string of twisted tobacco leaves according to a first aspect of the invention, an infeed conveyor and a device for wrapping overlaid tobacco leaves and a system according to a second aspect of the invention. The apparatus for twisting the string of wrapped and spun tobacco leaves into the string of twisted tobacco leaves is designated by 5, the infeed conveyor is designated the reference numeral 200 and the device which wraps overlaid tobacco leaves is indicated the reference numeral 100. The device 100, which wraps the overlaid tobacco leaves, is positioned so that the cavity 120 of the device 100, and thus the device 100 itself, forms an angle, e.g. an acute angle 202 relative to the parallel sides of the conveyor 200, to allow that the device 100 captures and picks up the overlaid tobacco leaves, e.g. leaves 341 and 342 from the infeed conveyor 200. Consequently, the device 100 is able to deliver the string 10 of the now wrapped and spun tobacco leaves to the apparatus 5 for a subsequent twisting of the string 10 of wrapped and spun tobacco leaves into the string 20 of twisted tobacco leaves. The twisting apparatus 5 and the wrapping device 100 are mechanically connected as one unit, which unit may be rotated round a pivot point located in the intersection of a centre line of the infeed conveyor and an axis extending along the cavity of the wrapping device 100. Rotation of the combined unit, which is constituted by the twisting apparatus 5 and the wrapping device 100, is performed by powering actuators connected to the unit in order to change the acute angle 202.

Figure 3:
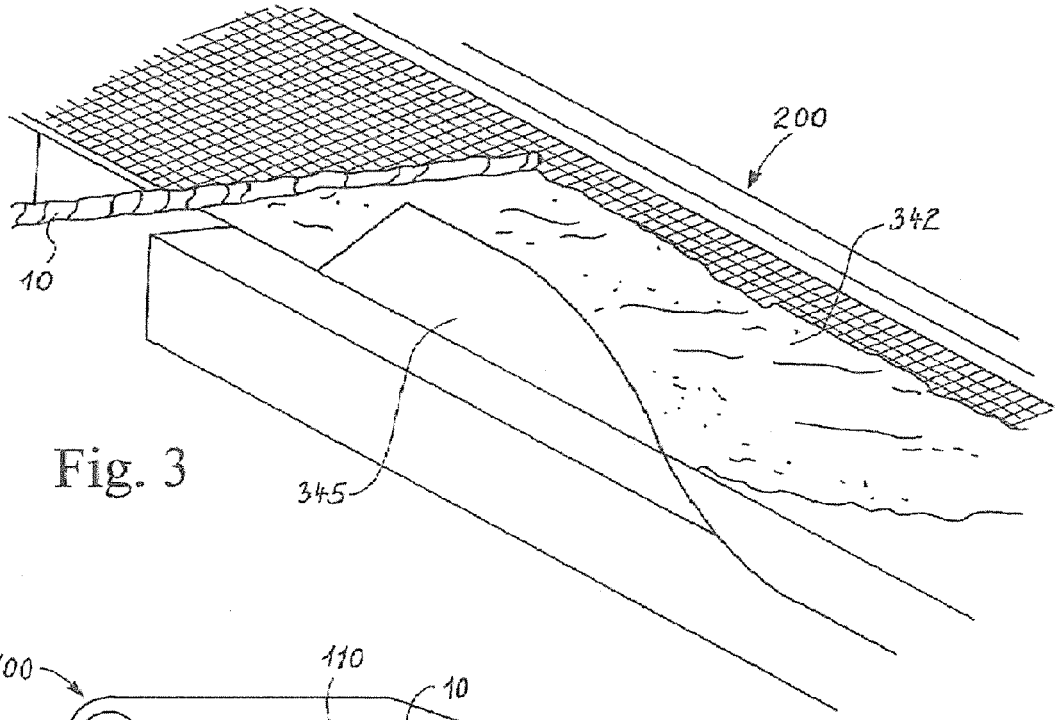
FIG. 3 shows a perspective drawing of the infeed conveyor.

FIG. 3 illustrates a perspective drawing of the infeed conveyor. The infeed conveyor 200 is provided with a guide plate 345. In some cases, e.g. the tobacco leaf 341 being too broad in the longitudinal direction, it is therefore necessary to fold parts of the tobacco leaf 342 onto itself. When the tobacco leaf to be folded is close to the edge of the infeed conveyor 200, the leaf 341 is automatically folded onto itself by means of the guide plate 345 when the conveyor 200 moves to the left. The infeed conveyor 200 is in an embodiment of the invention provided with holes for sucking air. These holes provide for that a tobacco leaf positioned on the conveyor is forced to substantially lay flat.

FIG. 4 illustrates a side view of the device 100 for wrapping overlaid tobacco leaves system according to the second aspect of the invention. The loose tobacco leaves 342, now in an overlaid configuration as overlaid tobacco leaves 341 and 342 (see FIG. 2), proceed by means of the infeed conveyor or belt 200 to the device 100 which wraps the overlaid tobacco leaves fed to it. The device 100 thereby produces a string 10 of wrapped and spun tobacco leaves. The string 10 of wrapped and spun tobacco leaves can also be seen in FIG. 3, where the device 100 for wrapping overlaid tobacco leaves, normally positioned over the string 10, has been removed from the conveyor 200. The string 10 (see FIG. 4) of wrapped and spun tobacco leaves is produced by means of a roller 110 in conjunction with a cavity 120, both being parts of the device 100 in its first variant. The roller 110 receives, e.g. captures and wraps the overlaid tobacco leaves provided from the right hand side of the device 100 from the infeed conveyor or belt 200. It is a condition that the roller speed, i.e. the velocity on the periphery of the roller is higher than the transporting speed of the infeed conveyor or belt 200 to enable the roller 110 to pick up the tobacco leaves fed to it. Hereby an outer layer of tobacco leaves is tightened around the string of tobacco leaves. The motor 140 (see FIG. 2) rotates the roller 110. The roller 110 may be driven by a toothed belt connected to the motor 140. To support the wrapping of the tobacco leaves, the cavity 120, which extends parallel to the roller 110 or the device 100 itself, is part of the device 100. The cavity 120 guides and acts as a counter hold for the overlaid tobacco leaves during the wrapping process.

In an alternative embodiment in the second variant of the device 100 (not shown), the roller 110 and the motor are omitted, whereby the string 10 is only guided by the cavity 120.

The device 100 for wrapping overlaid tobacco further comprises a shaft 130 in both variants, i.e. with or without the roller 110 and motor. The shaft 130 extends parallel with the roller 110 or parallel with the device 100 itself. The shaft 130 allows that the device 100 may be brought into an operational position, i.e. the position of the device 100 as illustrated in FIG. 4. Further, conversely the shaft 130 allows that the device 100 may be turned into an opened (not shown) position. The open position, i.e. a position where the device 100 is turned in a non-operating position, may be used for e.g. inspection, maintenance and/or cleaning of the device's 100 roller 110 and cavity 120. In the open position of the device 100, loose or sticking tobacco leave part may be removed from the roller 110 and from the cavity 120, and the roller 110 and cavity 120 may be further cleaned.

FIG. 5 illustrates a perspective drawing of a first prototype embodiment of an apparatus for twisting a string of wrapped and spun tobacco leaves into a string of twisted tobacco leaves according to the first aspect of the invention. The apparatus 5 serves the purpose of transforming the string of wrapped and spun tobacco leaves 10 provided from the device 100 into a string of twisted tobacco leaves 20. The apparatus 5 defines an axis 30, see also FIG. 2, which axis 30 extends substantially in the direction of the string of wrapped and spun tobacco leaves 10. The apparatus 5 of FIG. 5 in the first embodiment of the invention comprises a set of three rollers denoted 40, 50 and 60. Each of these rollers is provided with a circumferential respective twisting surface denoted 41, 51 and 61. The circumferential twisting surfaces 41, 51 and 61 are arranged to contact, e.g. to squeeze and to roll the string 10 of wrapped and spun tobacco leaves provided to the apparatus 5 from the device wrapping device 100. The circumferential twisting surfaces 41, 51 and 61 are e.g. formed in an hourglass shape, and may partly extend on the surface of their respective roller 40, 50 and 60.

Each of the rollers 40, 50 and 60 defines a corresponding rotational axis. The rotational axes of the set of rollers 40, 50 and 60 are arranged skewly relative to one another and relative to the axis 30. The three rollers 40, 50 and 60 may be arranged in a first plane perpendicular to the axis 30 and on a periphery of a circle having its centre on the first plane, such that a projection of the three rollers 40, 50 and 60 or a projection of the three corresponding rotational axes of the three rollers 40, 50 and 60 on a second plane perpendicular to the first axis 30 form a substantially equilateral triangle. The circumferential twisting surfaces 41, 51 and 61 of the rollers 40, 50, and 60, respectively, irrespective of the numbers of rollers applied, are arranged so that the circumferential twisting surfaces 41, 51 and 61 substantially confine the string of wrapped and spun tobacco leaves 10 and so that the string 10 of wrapped and spun tobacco leaves is rotated around the axis 30, i.e. around the axis of the string 10 itself.

Figure 5A:
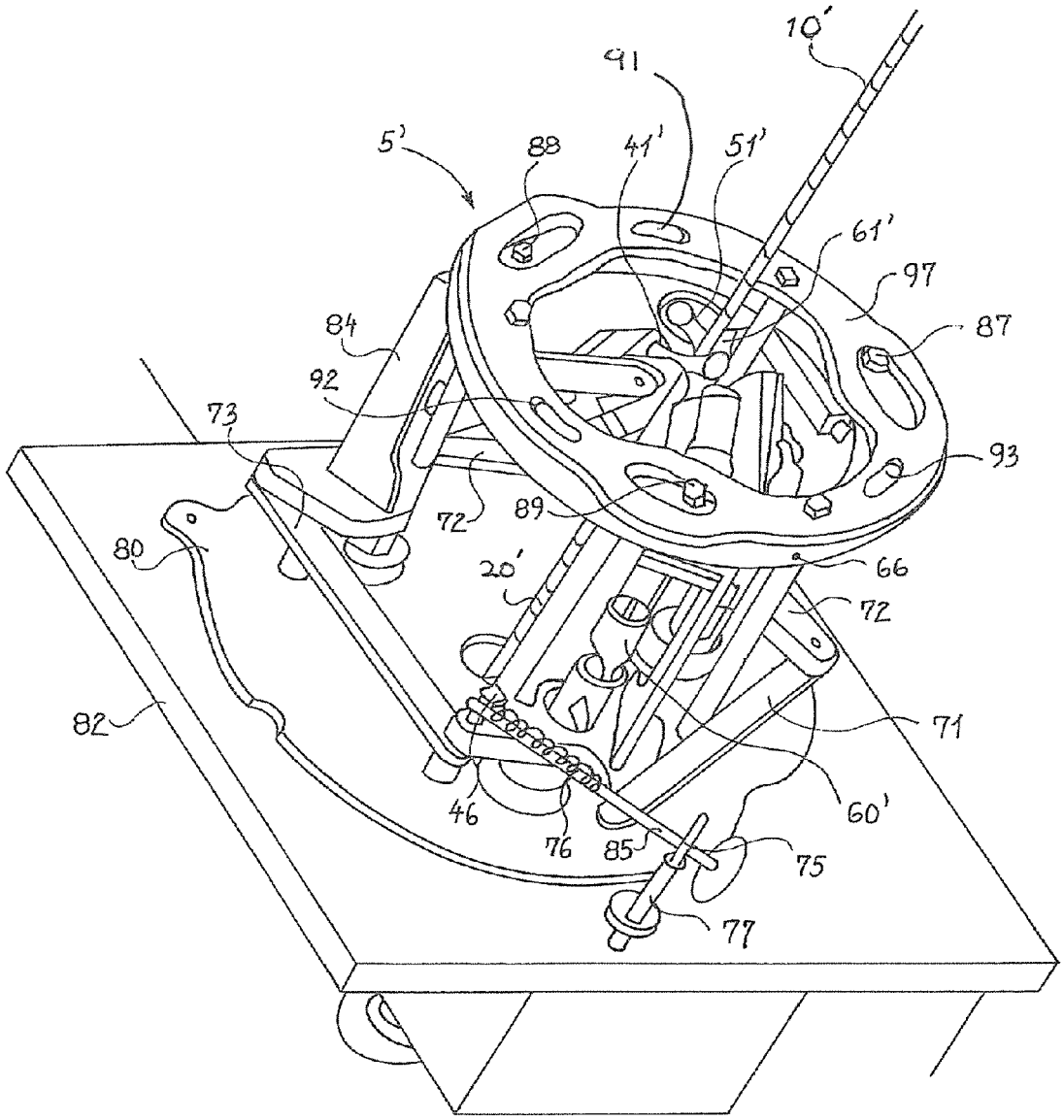
FIG. 5*a* shows a perspective drawing of a second preferred embodiment of an apparatus for twisting a string of wrapped and spun tobacco leaves into a string of twisted tobacco leaves according to the second preferred embodiment of the invention in the first aspect of the invention.

The prototype apparatus 5 of FIGS. 5 and 5*a* is further provided with a motor 70, see FIG. 2. The motor 70, see FIGS. 1 and 2, rotates the rollers 40, 50 and 60, when controlled to do so by a programmable controller. A toothed belt connected to the motor 70 may e.g. drive the rollers simultaneously. An example is shown in FIG. 5, where the wheel 43 is connectable to a toothed belt. The wheel 43 in turn drives the joints 42, 52, and 62 which drive the roller 50. Alternatively, a chain drives the rollers. The motor consequently rotates the rollers 40, 50 and 60 and causes the string 10 of wrapped and spun tobacco leaves to rotate around its own axis and the string 10 to be twisted by means of the twisting surfaces 41, 51 and 61 of the rollers 40, 50 and 60, respectively. Further, the twisting surfaces 41, 51 and 61 simultaneously cause the string 20 of twisted tobacco leaves to be conveyed along its axis and thus along the axis 30 and, to the left in the figure, out of the apparatus 5. As previously discussed, the string 20 (leaving the apparatus 5) of twisted tobacco leaves is fed to the spinning wheel 95, see FIG. 1.

FIG. 5*a* illustrates a perspective drawing of a second preferred embodiment of an apparatus 5' for twisting a string of wrapped and spun tobacco leaves 10' into a string of twisted tobacco leaves 20' according to the second preferred embodiment of the invention in the first aspect of the invention. The second preferred embodiment of the invention, i.e. the apparatus 5', serves the purpose of transforming the string of wrapped and spun tobacco leaves 10' provided from the device 100 into a string of twisted tobacco leaves 20' by means of three rollers of which only the roller 60' is clearly seen. The circumferential twisting surface 41', 51' and 61, as described in the foregoing figure, confine the string of wrapped and spun tobacco leaves 10', and when rotated simultaneously rotate the string 10' of wrapped and spun tobacco leaves into the string of twisted tobacco leaves 20' and cause the string 20' to be conveyed out of the apparatus 5'. The apparatus 5' is vertically mounted to a mounting plate 82 also shown in FIG. 2. In order to ease the mounting or demounting of the apparatus 5', it is provided with a support plate 80 to which three struts, of which only the strut 84 can be seen, are mounted. Further, a rod 77 is mounted to the mounting plate. Orthogonal to the rod, through a guiding eye 75, another rod 85 is mounted with a spring 76 at its opposite end. The spring 76 is mounted to a set of three levers 71, 72 and 73.

Figure 5B:
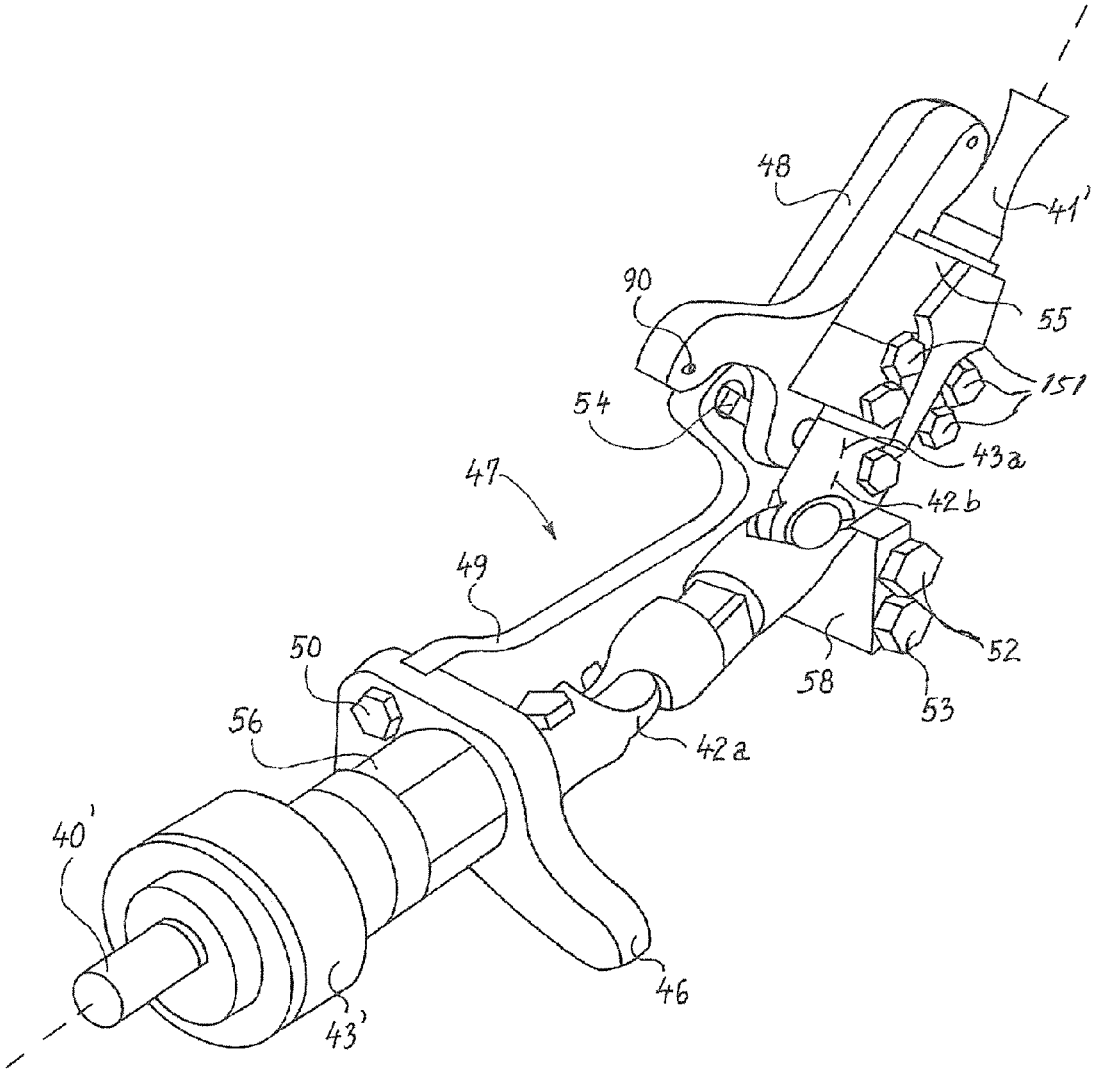
FIG. 5*b* shows a perspective drawing of an arrangement guiding the adjustment of a roller.

The three levers 71, 72 and 73 are mutually connecting 3 roller systems, one of which i.e. the roller systems 47 is shown in FIG. 5*b*. The roller system 47 is provided with a bearing housing 56 connected to the mounting plate 80 and containing not shown bearings, and a shaft 40' at the end of the roller with a tooth belt pulley 43'. The shaft 40' of the roller 40' extends through the bearing housing 56 and carries a bearing block 46 through not shown bearings and is at the end of the shaft 40' provided with a joint 42*a*. A guide plate 49 is connected to the bearing block 46 by two bolts 50 of which only one is shown. Another bearing block 58 is connected to the guide plate 49 by means of two bolts denoted 52 and 53 and has a threaded hole concentric to the shaft 40'. Three bolts 87, 88, 89 in FIG. 5*a* fix a shaft not shown to the bearing block 58, the shaft being supported by a bearing in the supporting ring 66. When so supported in the two bearings, one in the bearing block 46 and one in the supporting ring 66, the guide plate 49 can rotate freely around the axis of the shaft 40'.

The guide plate 49 extends to a point in line with the axis of the hourglass shaped twisting surface 41' and with a bearing centre in line with the smallest diameter of the hourglass shaped twisting surface 41'. A supporting plate 48 is supported rotatably at the end of the guide plate 49 and is guided in an arch shaped recess by a bush 54 and held by fixing it in the hole 90 at the top. A bearing housing 55 is mounted to the supporting plate 48 by means of four bolts 151. A roller 42*b* with the hourglass shaped twisting surface 41' is rotatable mounted in bearings in the bearing housing 55 and is connected to a joint 43*a*. The two joints 42*a* and 43*a* are connected by a shaft with a square shaped profile enabling an axial movement.

The function of the roller system 47 is to support the hourglass shaped twisting surface 41' in such a way that it can be rotated by the pulley 43' and have its angle to the first axis adjusted by elevating or lowering the supporting plate 48 and by moving the hourglass shaped twisting surface 41' against or away from the string of wrapped and spun tobacco leaves 10' to be twisted.

The function of the three levers 71, 72 and 73 connected to three roller systems, of which only the roller system 47 is shown, is to move the three roller systems relative to one another and to move them identically relative to the string 10' to be twisted when the three roller systems are influenced by the spring 76 and the wrapped and spun tobacco leaves 10'.

By means of the arrangement of the three levers 71, 72 and 73, the spring 76 and the three bearing blocks 46 mounted to the respective three rollers, a self adaptation of contacting the twisting surfaces 41', 51' and 61' in relation to the string of wrapped and spun tobacco leaves 10' is achieved.

The apparatus 5' is vertically mounted to a mounting plate 82 also shown in FIG. 2. In order to ease the mounting or the de-mounting of the apparatus 5', it is provided with a support plate 80 to which three struts, of which only one strut 84 can be seen, are mounted.

A front platform 97 is rotatably connected to the supporting ring 66 by means of three bolts through arc shaped recesses 91, 92 and 93. When the front platform 97 is loosened from the supporting ring 66 the front platform 97 in point 90 in FIG. 5*b* by means of three levers (not shown), each having spherical bearing in both ends, allows the angles (see e.g. the angle 57 in FIG. 5*b*) of the three twisting surfaces to be increased or deceased to substantially three identical values.

Figure 6:
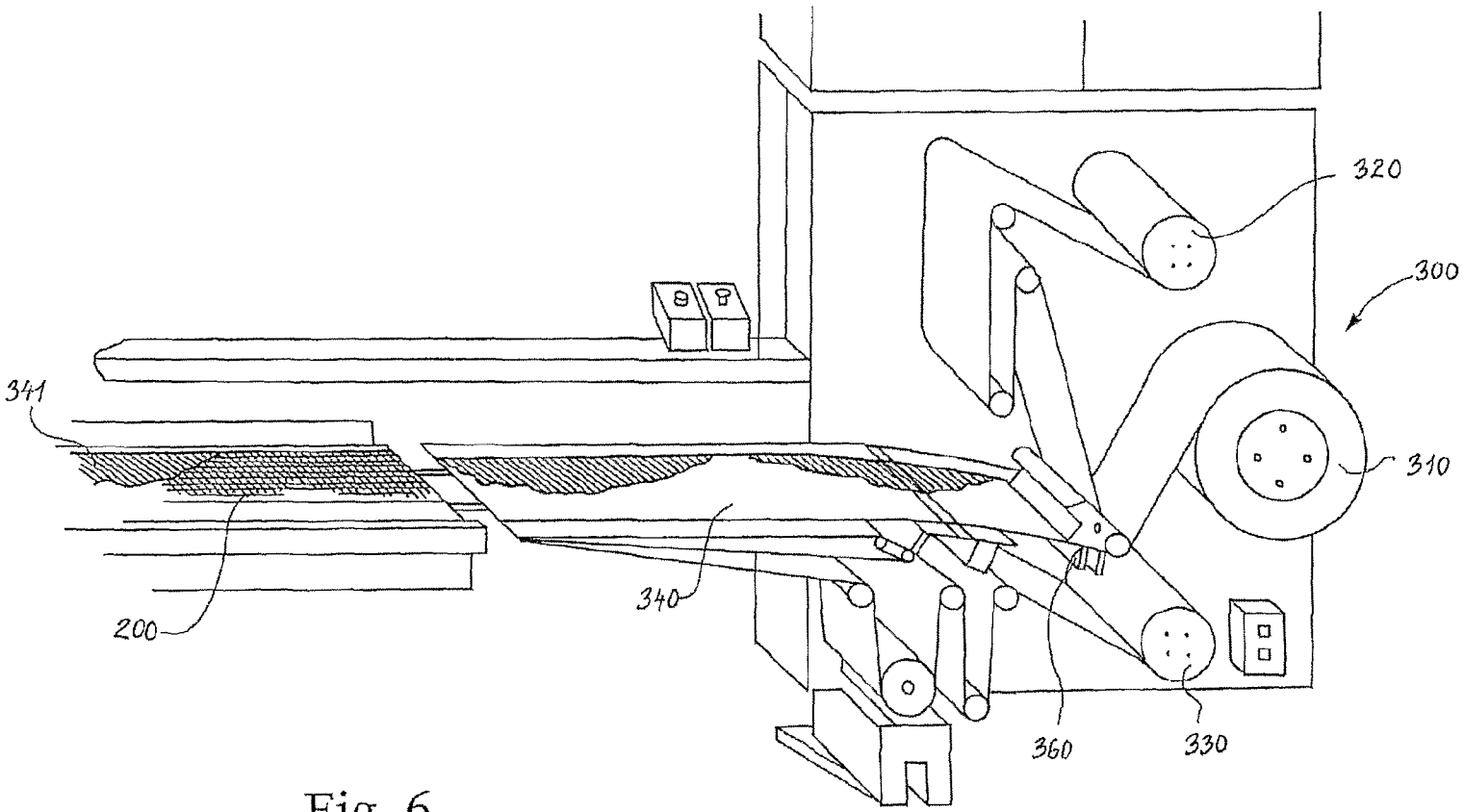
FIG. 6 shows a side view of a spools unit from which the tobacco leaves are provided.

FIG. 6 illustrates a side view of a spool unit from which the tobacco leaves are provided. The apparatus 300 is basically constituted by three controlled spools, spool 310 from which loose tobacco leaves are provided, and an upper spool 320 and a lower spool 330. The loose tobacco leaves are provided from and sandwiched between two webs wound on the spool 310. The two webs are unwound from the spool 310 onto the upper spool 320 and the lower spool 330, respectively. As a result of the spooling of the spools 310, 320 and 330, a loose tobacco leave 340 is the result. The apparatus 300 is further provided with a "doctors knife" 360 to control the webs. The apparatus 300, and accordingly the spools 310, 320 and 330, may be controlled by a programmable controller, e.g. a PLC, a microcomputer and/or a personal computer suitable for use in an industrial environment. The programmable controller is encased in the housing of the apparatus 300. The programmable controller may in an embodiment of the invention control spindles, motors, shaft etc. used to control the rotation of the spools.

In view of the above first, second and third aspects of the invention, it is clear for the person skilled in the art that according to a fourth aspect of the invention a method is provided. The method provides, in a generalised form, a string of twisted tobacco leaves and comprising the steps of:

(i) laying up two or more tobacco leaves in a partly overlapping relation, e.g. on the conveyor 200, subsequently the two or more tobacco leaves are to be (ii) caught and wrapped by means of a cavity in the device 100 for wrapping overlaid tobacco leaves, and optionally also with help of roller being parallel with the cavity, into a first string of wrapped and spun tobacco leaves, and (iii) finally, the first string of wrapped and spun tobacco leaves is rolled and twisted into a second string of twisted tobacco leaves, the rolling and twisting takes place by means of and within the apparatus 5, i.e. by means of the set of circumferential twisting surfaces of a respective set of skewly arranged rollers, between which surfaces the first string is confined. Simultaneous with the rolling and twisting, the second string of twisted tobacco leaves is conveyed along its longitudinal axis out of the twisting apparatus 5 or 5'.

Although the present invention has above been described with reference to advantageous and presently preferred embodiments of the four aspects of the invention, numerous modifications and changes of the apparatus, system, device and the method my be deduced and all such modifications and changes perceivable by a person having ordinary skill in the art are consequently to be considered part of the present invention, the protective scope of which is rather to be interpreted in accordance with the pending patent claims.

The invention claimed is:

1. An apparatus for twisting a first string of tobacco leaves into a second string of tobacco leaves, the apparatus defining a first axis extending substantially in the direction of the first string, the apparatus comprising:

a set of rollers, each of which defines a respective circumferential twisting surface for contacting the first string, and each of which defines a respective rotational axis, the rotational axes of the set of rollers being in a skewed arrangement relative to one another and relative to the first axis, the circumferential twisting surfaces being arranged so as to substantially confine the first string therebetween and so as to rotate the first string around the first axis; and a motor operable for rotating the set of rollers so as to cause the first string to rotate and be twisted by means of the twisting surfaces and simultaneously causing the second string to be conveyed along the first axis and out of the apparatus.

2. The apparatus of claim 1, wherein the set of rollers comprises at least three rollers.

3. The apparatus of claim 1, wherein the rollers are arranged in a first plane perpendicular to the first axis and on a periphery of a circle in the first plane, the circle having its center on the first axis such that a projection of the rollers on a second plane perpendicular to the first axis forms a substantially equilateral triangle.

4. The apparatus of claim 1, wherein each of the circumferential twisting surfaces is formed in an hourglass shape and has a friction-increasing pattern.

5. The apparatus of claim 1, wherein each of the set of rollers is driveable with the same speed and in the same rotational direction.

6. A system comprising:

an infeed conveyor operable for transporting overlaid tobacco leaves in a defined transporting direction and having substantially parallel sides;

a device positioned to receive the overlaid tobacco leaves from the infeed conveyor and operable for wrapping the overlaid tobacco leaves into a first string of tobacco leaves, the device comprising a cavity configured for guiding the tobacco leaves during wrapping, the cavity forming an acute angle relative to the defined transporting direction of the tobacco leaves; and an apparatus operable for twisting the first string of tobacco leaves into a second string of tobacco leaves, the apparatus defining a first axis extending substantially in the direction of the first string, the apparatus comprising:

a set of string-twisting rollers, each of which defines a respective circumferential twisting surface configured for contacting the first string, and each of which defines a respective rotational axis, the rotational axes of the set of string-twisting rollers being in a skewed arrangement relative to one another and relative to the first axis, the circumferential twisting surfaces being arranged so as to substantially confine the first string therebetween and so as to rotate the first string around the first axis; and a twisting apparatus motor operable for rotating the set of string-twisting rollers and causing the first string to rotate and be twisted by means of the twisting surfaces and simultaneously causing the second string to be conveyed along the first axis and out of the apparatus;

wherein the device is positioned such that the cavity of the device forms an acute angle relative to the parallel sides of the infeed conveyor, so as to allow the device to capture the overlaid tobacco leaves from the infeed conveyor and to deliver the first string of tobacco leaves to the apparatus.

7. The system of claim 6, wherein the string-twisting rollers are arranged in a first plane perpendicular to the first axis and on a periphery of a circle in the first plane, the circle having its center on the first axis such that a projection of the string-twisting rollers on a second plane perpendicular to the first axis forms a substantially equilateral triangle.

8. The system of claim 6, wherein each of the circumferential twisting surfaces is formed in an hourglass shape and has a friction-increasing pattern.

9. The system of claim 6, wherein each of the set of string-twisting rollers is driveable with the same speed and in the same rotational direction.

10. The system of claim 6, wherein the device comprises:

a wrapping roller configured for catching and wrapping the tobacco leaves;

a cavity extending parallel to the wrapping roller and configured for guiding the tobacco leaves during wrapping, the cavity forming an acute angle relative to the defined transporting direction of the overlaid tobacco leaves; and a wrapping roller motor operable for rotating the wrapping roller.

11. The system of claim 10, wherein the device further comprises a shaft extending parallel to the wrapping roller, the shaft being configured to allow the device to be turned between an operational position and an opened, non-operational position.

12. The system of claim 10, wherein the device comprises a cavity extending parallel to the wrapping roller and configured for guiding the overlaid tobacco leaves during wrapping, the cavity forming an acute angle relative to the defined transporting direction of the tobacco leaves.

13. The device of claim 12, further comprising a shaft extending parallel to the cavity, the shaft being configured to allow the device to be turned between an operational position and an opened, non-operational position.

14. A method of providing a string of twisted tobacco leaves, the method comprising the steps of:

(i) laying up two or more tobacco leaves in a partly overlapping relation;

(ii) catching the tobacco leaves in a cavity and wrapping the tobacco leaves in the cavity into a first string of wrapped and spun tobacco leaves; and (iii) rolling and twisting the first string into a second string of twisted tobacco leaves by means of a set of circumferential twisting surfaces of a respective set of string-twisting rollers having rotational axes in a skewed arrangement relative to each other, between which surfaces the first string is confined, whilst simultaneously conveying the second string along its longitudinal axis.

15. The method of claim 14, wherein, before the step of laying up two or more tobacco leaves, the method further comprises the steps of:

providing a spool comprising two or more tobacco leaves; and unwinding, from said spool, said two or more tobacco leaves.

* * * * *